US009309102B2

(12) United States Patent
Martin

(10) Patent No.: US 9,309,102 B2
(45) Date of Patent: Apr. 12, 2016

(54) WINE STORAGE AND DISPENSING DEVICE WITH AIR REMOVAL SYSTEM

(71) Applicant: Tristan Martin, Vancouver, WA (US)

(72) Inventor: Tristan Martin, Vancouver, WA (US)

( * ) Notice: Subject to any disclaimer, the term of this patent is extended or adjusted under 35 U.S.C. 154(b) by 0 days.

(21) Appl. No.: 14/209,127

(22) Filed: Mar. 13, 2014

(65) Prior Publication Data

US 2014/0263412 A1 Sep. 18, 2014

Related U.S. Application Data

(60) Provisional application No. 61/789,301, filed on Mar. 15, 2013.

(51) Int. Cl.
*B67D 1/00* (2006.01)
*B67D 1/07* (2006.01)

(52) U.S. Cl.
CPC ..... *B67D 1/0004* (2013.01); *B67D 1/0001* (2013.01); *B67D 1/07* (2013.01)

(58) Field of Classification Search
CPC ..... B67D 1/0004; B67D 1/0001; B67D 1/07
USPC ..... 222/108, 251, 481, 481.5, 563, 105
See application file for complete search history.

(56) References Cited

U.S. PATENT DOCUMENTS

| | | | | |
|---|---|---|---|---|
| 4,595,121 | A * | 6/1986 | Schultz | 222/1 |
| 5,826,752 | A * | 10/1998 | Latimer | 222/105 |
| 2006/0118574 | A1* | 6/2006 | Anderson et al. | 222/1 |
| 2007/0284389 | A1* | 12/2007 | Jacobs | 222/1 |
| 2009/0078721 | A1* | 3/2009 | Hoffman et al. | 222/1 |
| 2011/0204093 | A1* | 8/2011 | Lee | 222/152 |
| 2011/0210143 | A1* | 9/2011 | Jones | 222/1 |
| 2013/0214000 | A1* | 8/2013 | Stratton | 222/95 |

* cited by examiner

*Primary Examiner* — Donnell Long
(74) *Attorney, Agent, or Firm* — Schwabe, Williamson & Wyatt, PC

(57) ABSTRACT

In an example, a wine storage and dispensing device is provided. The wine storage and dispensing device may include a wine storage reservoir having a first opening and a second opening that is different than the first opening, the second opening located above the first opening on the wine storage reservoir. The wine storage and dispensing device may include a dispensing device coupled to the first opening, and an air removal system coupled to the second opening of the storage reservoir.

2 Claims, 9 Drawing Sheets

WINE STORAGE AND DISPENSING DEVICE WITH AIR REMOVAL SYSTEM

PRIORITY

This application claims benefit of U.S. Provisional Application No. 61/789,301 filed on Mar. 15, 2013, entitled: WINE STORAGE AND DISPENSING DEVICE WITH AIR REMOVAL SYSTEM, which is herein incorporated by reference in its entirety.

COPYRIGHT NOTICE

© 2014 Tristan Martin. A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR §1.71(d).

TECHNICAL FIELD

This disclosure relates generally to a liquid storage and dispensing devices, and, more particularly, to a wine storage and dispensing device with an integrated air removal system.

BACKGROUND

Wine is predominantly packaged and sold in 750 ml glass bottles. Since wine can degrade with prolonged exposure to oxygen, consumers often open bottled wines when the contents can be consumed in one sitting, thus avoiding the degradation due to prolonged exposure to oxygen. If the contents of a bottle of wine are not consumed in one sitting, consumers often dispose of the remaining wine or may consume a degraded version of the wine at a future date.

One common solution to avoiding oxygen degraded wine is to vacuum seal a partially consumed bottle of wine. Typically, this solution requires a specialized bottle topper and separate pump attachment. While this solution can remove some air from the wine bottle, a fair amount of air usually remains in the bottle, as the glass bottle cannot support a full vacuum. Further, each time a bottle is reopened, the bottle will again need to be vacuum sealed in order to preserve the remaining wine in the bottle.

SUMMARY OF THE INVENTION

The following is a summary of the invention in order to provide a basic understanding of some aspects of the invention. This summary is not intended to identify key/critical elements of the invention or to delineate the scope of the invention. Its sole purpose is to present some concepts of the invention in a simplified form as a prelude to the more detailed description that is presented later.

In an example, a wine storage and dispensing device is provided. The wine storage and dispensing device may include a wine storage reservoir having a first opening and a second opening that is different than the first opening, the second opening located above the first opening on the wine storage reservoir. The wine storage and dispensing device may include a dispensing device coupled to the first opening, and an air removal system coupled to the second opening of the storage reservoir.

In an example, the air removal system may include a valve system having an open position to allow a portion of contents of the wine storage reservoir to be forced out of the wine storage reservoir and a close position to lock air out of the wine storage reservoir after forcing the portion of the contents out of the wine storage reservoir. The air removal system may include an overflow reservoir to collect a portion of wine of the evacuated contents.

Additional aspects and advantages of this invention will be apparent from the following detailed description of preferred embodiments, which proceeds with reference to the accompanying drawings.

DETAILED DESCRIPTION

Figure 1:
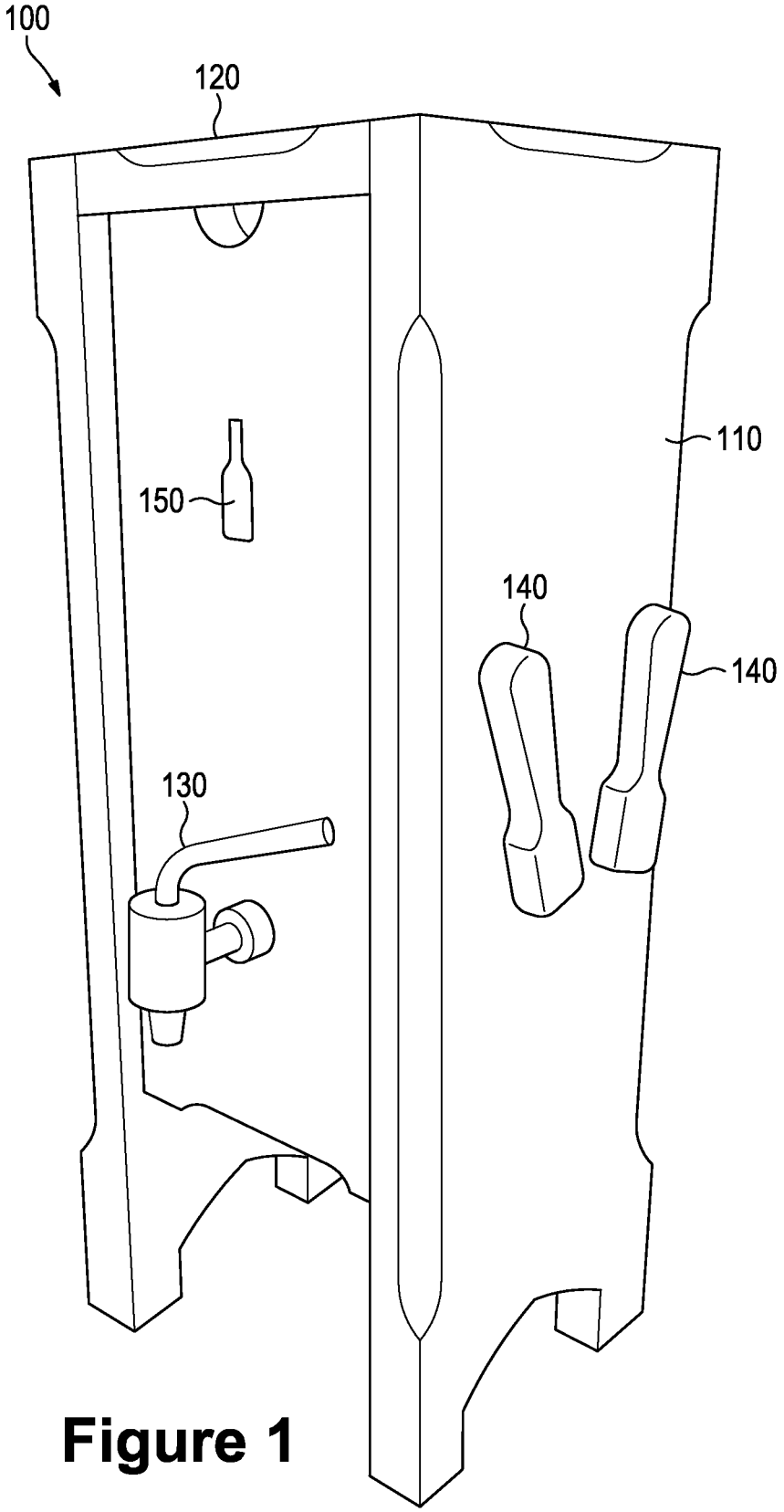
FIG. 1 is a picture of a wine storage and dispensing device with an integrated air removal system.

FIG. 1 is an example picture of a wine storage and dispensing device 100 with an integrated air removal system. Referring to FIG. 1, the wine storage and dispensing device 100 includes a housing 110 to at least partially encapsulate or surround a storage reservoir and the air removal system. The housing can be made of wood, as shown in FIG. 1, plastic, metal, or any other material that can support the storage reservoir and the air removal system, or any combination thereof.

The housing 110 can include a lid 120, for example, which can be coupled to the housing 110 with a hinge (not shown), and open to at least partially reveal the storage reservoir and the air removal system. In some embodiments, the lid 120, when open, can allow for a liquid, such as wine, to be poured into the storage reservoir. The storage reservoir can be any size, but, in some embodiments, can be large enough to accommodate a standard 750 ml bottle of wine.

The wine storage and dispensing device 100 includes a dispensing device 130, which can be coupled to the storage reservoir, for example, at the bottom of the storage reservoir, and allow for liquid or other contents of the storage reservoir to be dispensed. The dispensing device 130 can be a faucet or valve, which can be opened to dispense liquid from the storage reservoir and closed to retain liquid in the storage reservoir. Although FIG. 1 shows a manual-controlled dispensing device 130, in some embodiments, the dispensing device 130 can be at least partially automated, for example, with an electronically controlled valve to dispense wine from the storage reservoir.

As will be described below in greater detail, the wine storage and dispensing device 100 includes an integrated air removal system, which can evacuate air from the storage reservoir—eliminating or reducing oxidation of the wine in the storage reservoir. The wine storage and dispensing device 100 can include one or more air evacuation handles 140, which can be actuated to evacuate air form the storage reservoir. In some embodiments, the housing 110 can include a view window 150 to allow visual inspection of at least a portion of the integrated air removal system. For example, the view window 150 can reveal at least a portion of a conduit utilized to evacuate the air from the storage reservoir. When the air evacuation handles 140 are moved, the view window 150 can show wine or other liquid passing through the conduit, which can indicate that air has been sufficiently evacuated from the storage reservoir and a valve of the integrated air removal system (not shown) can be closed to lock the removed air outside of the storage reservoir and associated air removal system, which can help preserve the wine or other liquid from oxidation.

Figure 2:
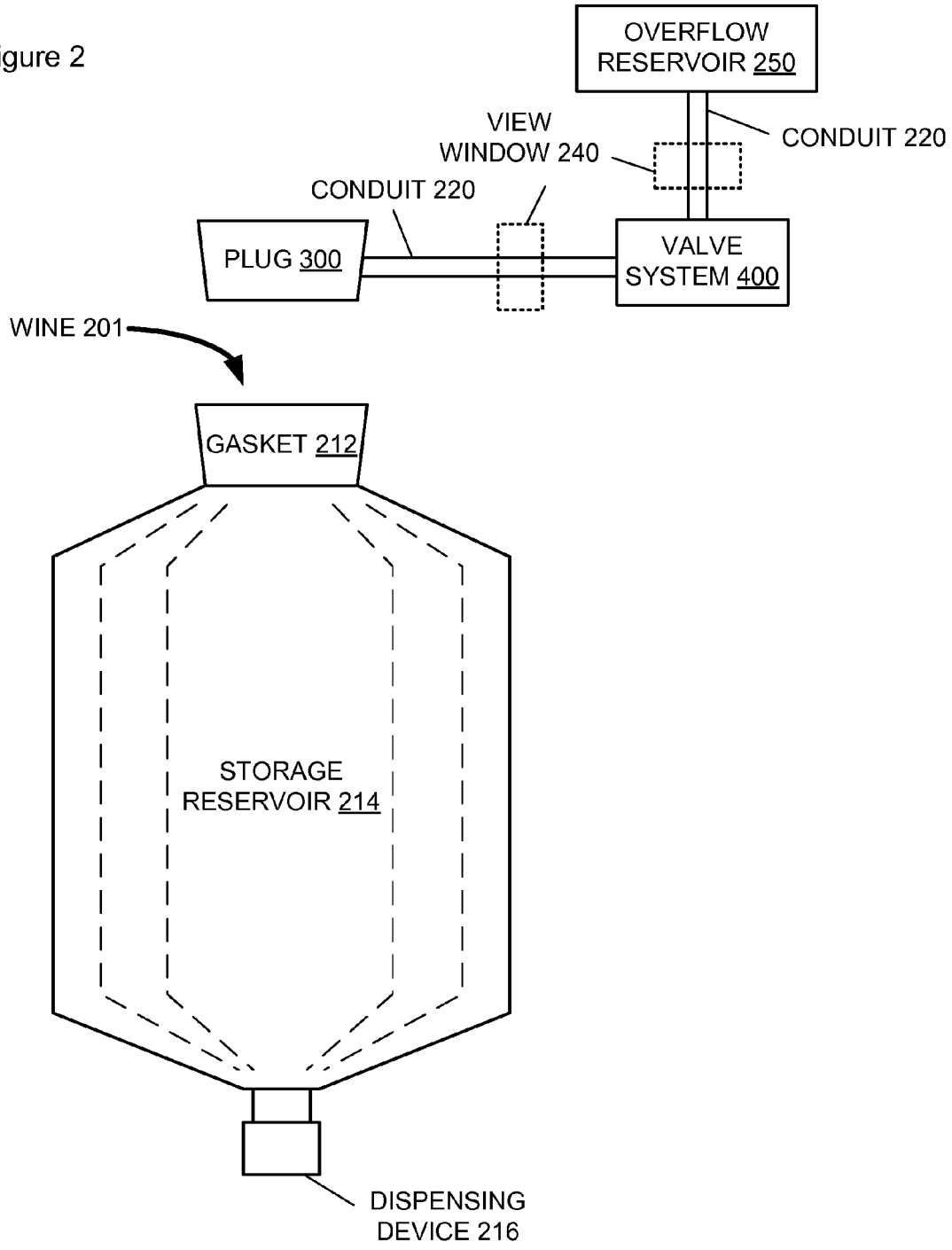
FIG. 2 is a block diagram example of the wine storage and dispensing device with an integrated air removal system.

FIG. 2 is a block diagram example of the wine storage and dispensing device with the integrated air removal system. Referring to FIG. 2, the wine storage and dispensing device can include a storage reservoir 214 to hold liquid, such as wine, and/or other contents. The storage reservoir 214 can be a bag or other flexible structure that can expand and contract. The storage reservoir 214 can be made of plastic, rubber, or any other flexible material capable of holding liquid or air.

The storage reservoir 214 can have an opening coupled to a gasket 212 and another opening coupled to a dispensing device 216. The gasket 212 can be located at the upper end of the storage reservoir 214 and configured to detachably couple with a plug 300. Wine 201 can be poured into the storage reservoir 214 through the gasket 212.

The wine 201 can be dispensed from the storage reservoir 214 through the dispensing device 216. The dispensing device 216 can be coupled to the storage reservoir 214, for example, at the bottom of the storage reservoir 214, and allow for liquid or other contents of the storage reservoir to be dispensed. The dispensing device 216 can be a faucet or valve, which can be opened to dispense liquid from the storage reservoir 214 and closed to retain liquid in the storage reservoir 214.

The integrated air removal system can include a plug 300 to detachably couple with the gasket 212, for example, after the wine 201 has been placed in the storage reservoir 214 (with the dispensing device 216 closed). The plug 300 can be coupled with the gasket 212 to create a substantially air-tight fit where the plug 300 and gasket 212 come in contact with each other.

Figure 3A:
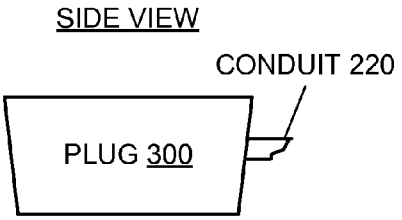
FIGS. 3A-3C are block diagram examples of a plug shown in FIG. 2.
Figure 3B:
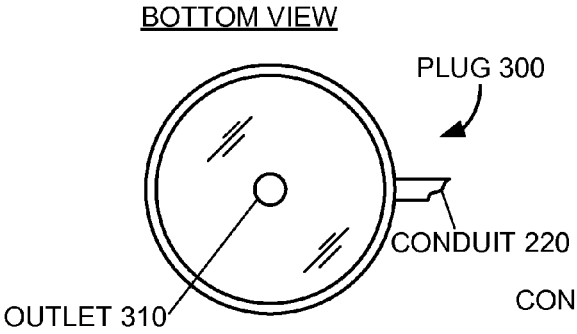
Figure 3C:
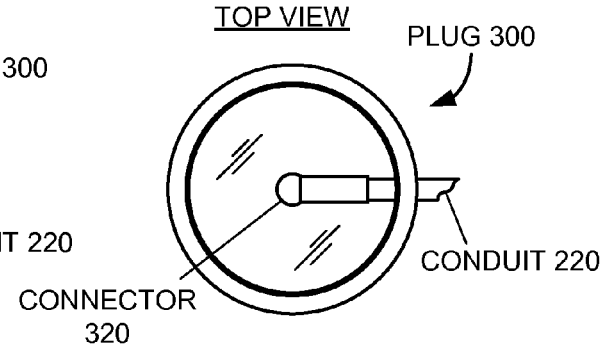

FIGS. 3A-3C are block diagram examples of a plug 300 shown in FIG. 2. Referring to FIGS. 3A-3C, the plug 300 can include an outlet 310 and a connector 320 to allow contents of the storage reservoir 214 to pass through to the conduit 220, for example, during an air evacuation operation.

Referring back to FIG. 2, the integrated air removal system can include a valve system 400, which can open to allow contents of the storage reservoir 214, such as wine 201 and air to flow through the valve system 400. The valve system 400 can close to create a closed-system, which can include the contents of the storage reservoir 214 and any contents in a conduit 220 between the plug 300 and the valve system 400.

During an air evacuation operation, the integrated air removal system can allow air to be forced from the storage reservoir 214 through the plug 300 and at least a portion of the conduit 220 towards the valve system 400. In some embodiments, as will be described below in FIGS. 5A-5B, the integrated air removal system can include a mechanism to compress the storage reservoir 214, which can push the contents of the storage reservoir 214 towards the valve system 400 through the plug 300 and conduit 220. In other embodiments, as will be described below in FIG. 6, the integrated air removal system can include a vacuum system to draw contents of the storage reservoir 214 towards the valve system 400 through the plug 300 and conduit 220.

Since the storage reservoir 214 includes tapered upper portions coupled to the gasket 212, air in the storage reservoir 214 can be passed through the gasket 212 before the wine 201 is passed through the gasket 212. The air can traverse through the plug 300, conduit 220, and the valve system 400 while the valve system 400 is open. The valve system 400 can be closed to create a closed-system after air is removed from the storage reservoir 214. In some embodiments, the valve system 400 can be closed to allow a small amount of air to remain in the conduit 220, which can err on the side of retaining the wine 201 in the wine storage and dispensing device. While in other embodiments, the valve system 400 can be closed after at least some of the wine 201 has passed through the valve system 400, which can err on the side of removing the air from the wine storage and dispensing device.

The integrated air removal system can include a view window 240, which can allow a visual inspection of the conduit 220 during an air evacuation operation. The view window 240 can be located on either anywhere on the conduit 220. In some embodiments, the view window 240 can be utilized to determine when enough air has been removed from the storage reservoir 214 to close the valve system 400. For example, when the portion of the conduit 220 in the view window 240 includes liquid rather than air, the valve system 400 may be closed to lock the air out of the storage reservoir. In some cases, a residual amount of air may remain in the closed-system, while, in other cases, a small amount of wine may reside outside of the closed-system.

Figure 4A:
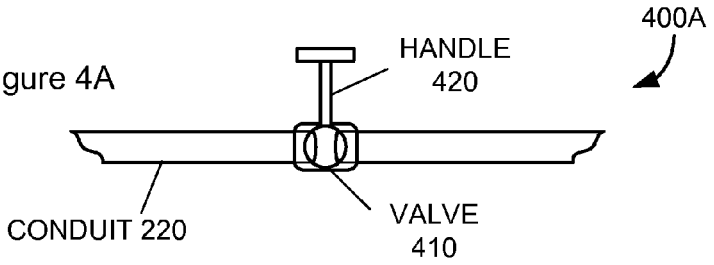
FIGS. 4A-4B are block diagram examples of the valve system shown in FIG. 2.
Figure 4B:
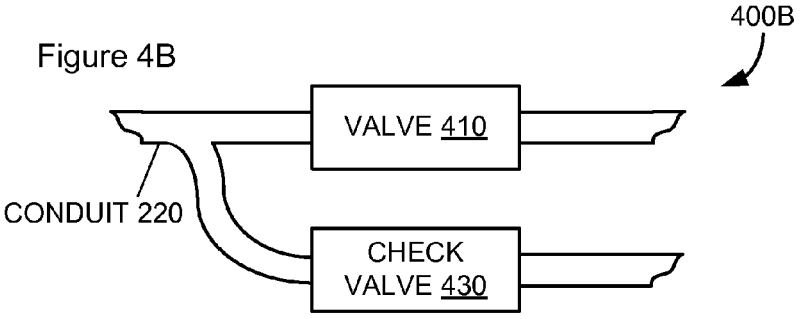

FIGS. 4A-4B are block diagram examples of the valve system 400 shown in FIG. 2. Referring to FIG. 4A, the valve system 400A can include a valve 410 coupled in-line with the conduit 220. The valve 410 can open to allow contents of the storage reservoir 214, such as wine 201 and air to flow through the conduit 220. The valve system 400 can close to create a closed-system, which can include the contents of the storage reservoir 214 and any contents in a conduit 220 between the plug 300 and the valve system 400. The valve system 400A can include a handle 420 that, when rotated, can open or close the valve 410. In some embodiments, the valve system 400A can include other mechanisms for opening or closing the valve 410, which can be manual, automated, or a combination thereof.

Referring to FIG. 4B, the valve system 400B can include a valve 410 coupled in-line with a first branch of the conduit 220. The valve 410 can open to allow contents of the storage reservoir 214, such as wine 201 and air to flow through the conduit 220. The valve system 400 can close to create a closed-system, which can include the contents of the storage reservoir 214 and any contents in a conduit 220 between the plug 300 and the valve system 400B.

The valve system 400B can include a check valve 430 coupled in-line with a second branch of the conduit 220. During an air evacuation operation, the valve 410 can be closed, allowing contents from the storage reservoir 214 to pass through the check valve 430. Since the check valve 430 provides a one-way path for the contents from the storage reservoir 214, once air is evacuated from the storage reservoir 214 through the check valve 430, the air remains outside of the closed system.

Referring back to FIG. 2, the integrated air removal system can include an overflow reservoir 250 to capture any contents from the storage reservoir 214 that pass through the valve system 400 and the remaining portion of the conduit 220. The overflow reservoir 250 can help to alleviate any mess when excess liquid or wine is forced or drawn through the valve system 400 during an air evacuation operation or a device cleaning operation. In some embodiments, the overflow reservoir 250 can be removed from the integrated air removal system, for example, to dispose its contents.

After the air evacuation operation, the wine 201 can be dispensed from the storage reservoir 214 through the dispensing device 216. The storage reservoir 214 can compress while the wine 201 is being dispensed. When a majority of the wine 201 has been dispensed, in some embodiments, the valve system 400 can open—allowing air to return to the storage reservoir 214—to allow for a final dispensing of the remaining wine in the storage reservoir 214. To clean the wine storage and dispensing device, the storage reservoir 214 can be filled with a cleaning solution or water, which can be forced or drawn through an open valve system 400 before being dispensed through the dispensing device 216.

Figure 5A:
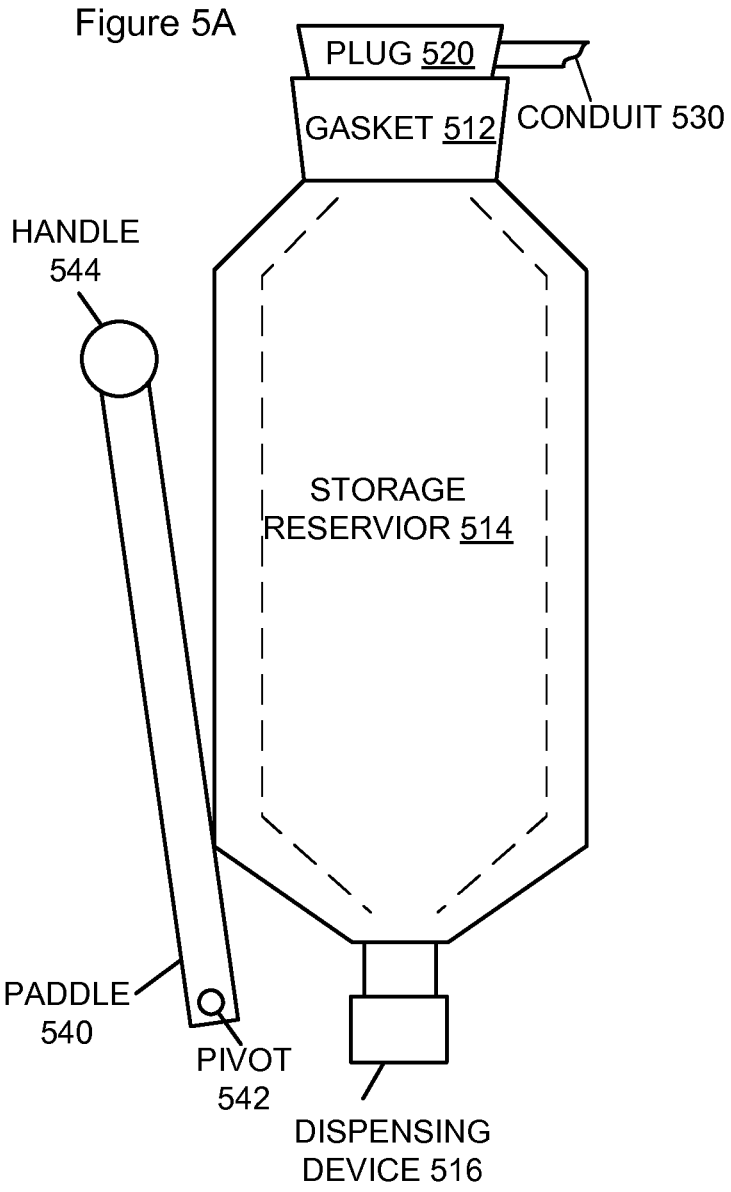
FIGS. 5A-5B are block diagram examples of a mechanical compression system for an integrated air removal system shown.
Figure 5B:
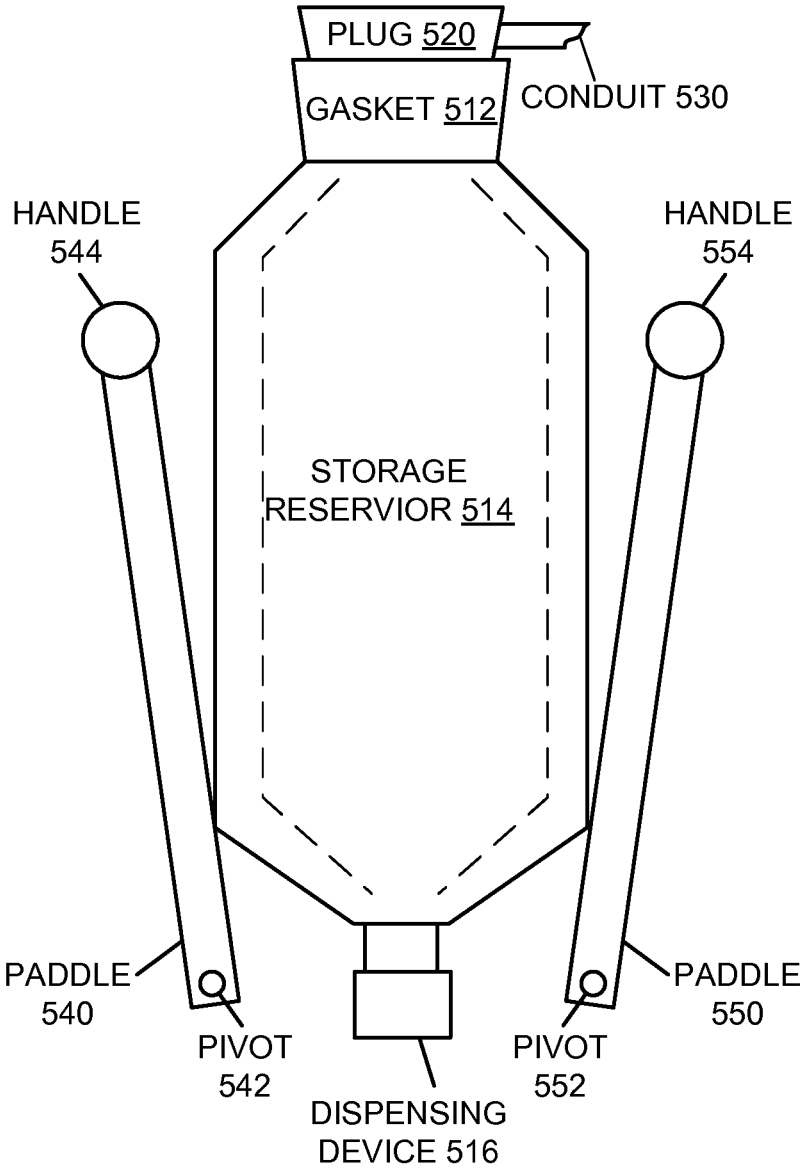

FIGS. 5A and 5B are block diagram examples of a mechanical compression system for an integrated air removal system shown. Referring to FIGS. 5A and 5B, the wine storage and dispensing device can include a storage reservoir 514 to hold liquid, such as wine, and/or other contents. The storage reservoir 514 can be a bag or other flexible structure that can expand and contract. The storage reservoir 514 can be made of plastic, rubber, or any other flexible material capable of holding liquid or air.

The storage reservoir 514 can have an opening coupled to a gasket 512 and another opening coupled to a dispensing device 516. The gasket 512 can be located at the upper end of the storage reservoir 514 and configured to detachably couple with a plug 520. Wine can be poured into the storage reservoir 514 through the gasket 512.

The wine can be dispensed from the storage reservoir 514 through the dispensing device 516. The dispensing device 516 can be coupled to the storage reservoir 514, for example, at the bottom of the storage reservoir 514, and allow for liquid or other contents of the storage reservoir to be dispensed. The dispensing device 516 can be a faucet or valve, which can be opened to dispense liquid from the storage reservoir 514 and closed to retain liquid in the storage reservoir 514.

The integrated air removal system can include a plug 520 to detachably couple with the gasket 512, for example, after the wine has been placed in the storage reservoir 514 (with the dispensing device 516 closed). The plug 520 can be coupled with the gasket 512 to create a substantially air-tight fit where the plug 520 and gasket 512 come in contact with each other.

During an air evacuation operation, the integrated air removal system can allow air to be forced from the storage reservoir 514 through the plug 520 and at least a portion of the conduit 530 towards a valve system. As shown in FIG. 5A, the integrated air removal system can include a paddle 540 to press on the storage reservoir 514, which can force the contents of the storage reservoir 514 towards the valve system through the plug 520. As shown in FIG. 5B, the integrated air removal system can include a pair of paddles 540 and 550 to press on the storage reservoir 514, which can force the contents of the storage reservoir 514 towards the valve system through the plug 520. In an example, a relief may be cut into a surface of the paddle 540 that faces the storage reservoir 514 to allow for more expansion of the storage reservoir 514 responsive to filling. A similar relief may be cut into a surface of an inside of sidewalls of housing corresponding to the front and back of the storage reservoir 514.

In some embodiments, the paddles 540 and 550 can have handles 544 and 554, which can allow a user or mechanism to move them, for example, rotate them around pivots 542 and 552, respectively. Although FIGS. 5A and 5B show several particular mechanisms, any number of other mechanisms can be utilized to compress the storage reservoir 514 and force the air from the storage reservoir 514.

Figure 6:
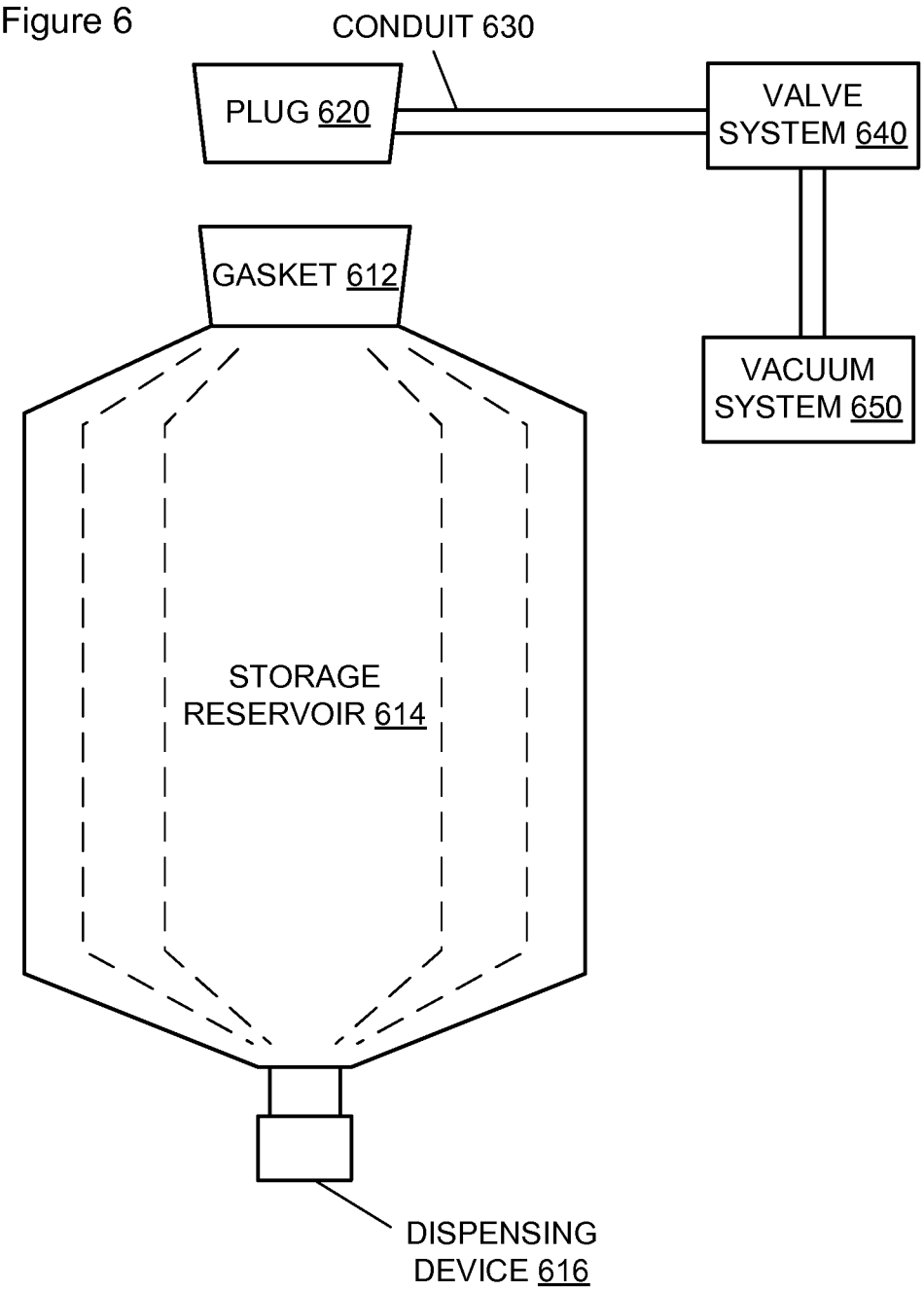
FIG. 6 is block diagram example of a vacuum compression system for an integrated air removal system shown.

FIG. 6 is block diagram example of a vacuum compression system for an integrated air removal system shown. Referring to FIG. 6, the wine storage and dispensing device can include a storage reservoir 614 to hold liquid, such as wine, and/or other contents. The storage reservoir 614 can be a bag or other flexible structure that can expand and contract. The storage reservoir 614 can be made of plastic, rubber, or any other flexible material capable of holding liquid or air.

The storage reservoir 614 can have an opening coupled to a gasket 612 and another opening coupled to a dispensing device 616. The gasket 612 can be located at the upper end of the storage reservoir 614 and configured to detachable couple with a plug 620. Wine can be poured into the storage reservoir 614 through the gasket 612.

The wine can be dispensed from the storage reservoir 614 through the dispensing device 616. The dispensing device 616 can be coupled to the storage reservoir 614, for example, at the bottom of the storage reservoir 614, and allow for liquid or other contents of the storage reservoir to be dispensed. The dispensing device 616 can be a faucet or valve, which can be opened to dispense liquid from the storage reservoir 614 and closed to retain liquid in the storage reservoir 614.

The integrated air removal system can include a plug 620 to detachably couple with the gasket 612, for example, after the wine has been placed in the storage reservoir 614 (with the dispensing device 616 closed). The plug 620 can be coupled with the gasket 612 to create a substantially air-tight fit where the plug 620 and gasket 612 come in contact with each other.

During an air evacuation operation, the integrated air removal system can draw air from the storage reservoir 614 through the plug 620 and at least a portion of the conduit 630 towards a valve system 640. The integrated air removal system can include a vacuum system 650 to draw contents of the storage reservoir 614 through the plug 620 towards the valve system 640. The vacuum system 650 can be turned-on to draw the contents of the storage reservoir 614 towards the valve system 640, and turned-off once the contents have reached a predetermined distance through the conduit 630. In some embodiments, the valve system 640 can be closed at approximately the same time as the vacuum system 650 is turned-off. When the valve system 640 includes a check valve, as shown in FIG. 4B, the vacuum system can turn-off and the valve system 640 will automatically be in a closed-system state.

Figure 7:
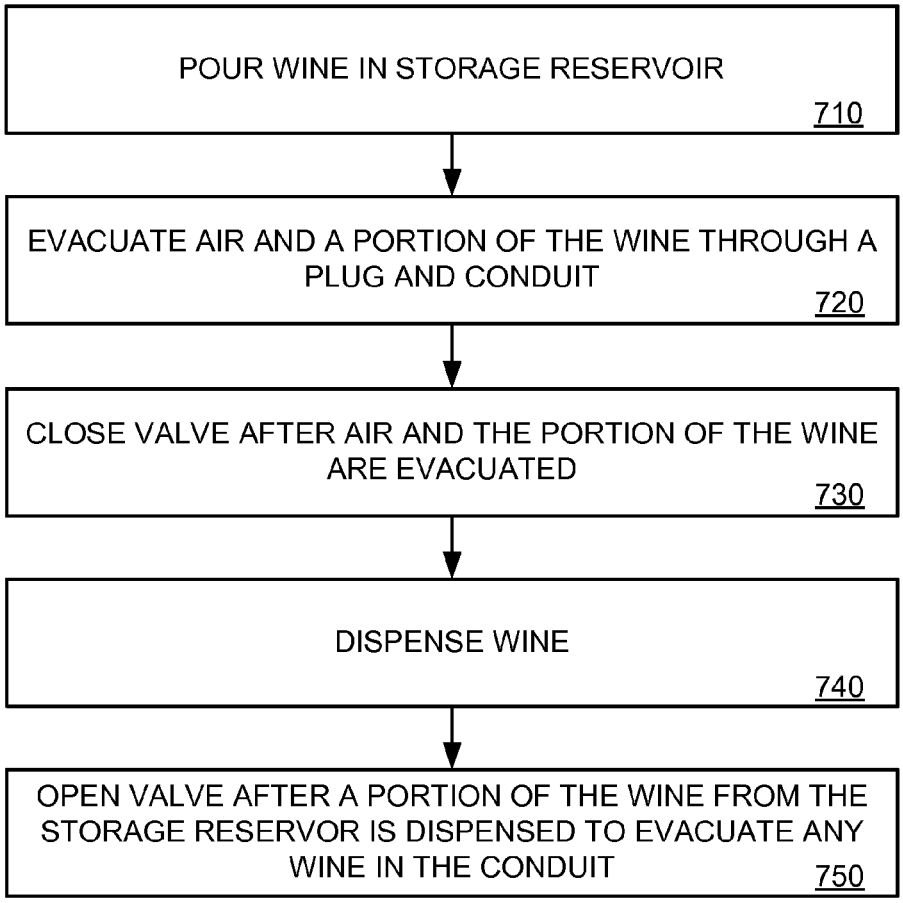
FIG. 7 is an example flow diagram for operating the wine storage and dispensing device with the integrated air removal system.

FIG. 7 is an example flow diagram for operating the wine storage and dispensing device with the integrated air removal system. Referring to FIG. 7, in a block 710, wine can be poured in storage reservoir. In a block 720, air and a portion of the wine can be evacuated through a plug and conduit. In a block 730, the valve can be closed after air and the portion of the wine are evacuated. In a block 740, the wine can be dispensed. In a block 750, the valve can be opened after a portion of the wine from the storage reservoir is dispensed to evacuate any wine in the conduit.

Figure 8:
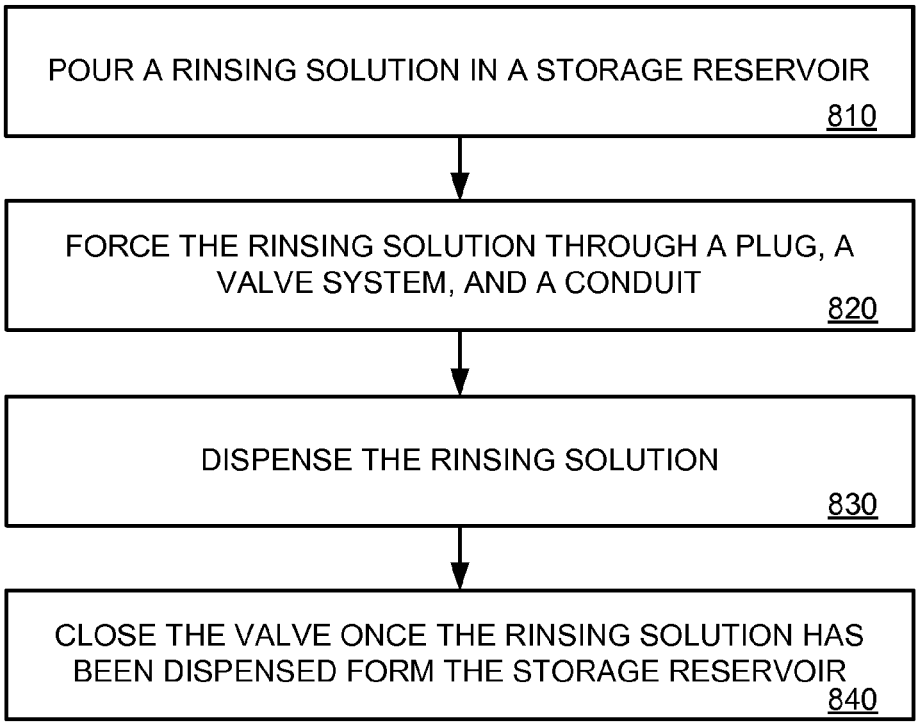
FIG. 8 is an example flow diagram for cleaning the wine storage and dispensing device with the integrated air removal system.

FIG. 8 is an example flow diagram for cleaning the wine storage and dispensing device with the integrated air removal system. Referring to FIG. 8, in a block 810, a rinsing solution can be poured in a storage reservoir. In a block 820, the rinsing solution can be forced through a plug, a valve system, and a conduit. In a block 830, the rinsing solution can be dispensed. In a block 840, the valve can be closed once the rinsing solution has been dispensed form the storage reservoir.

Figure 9A:
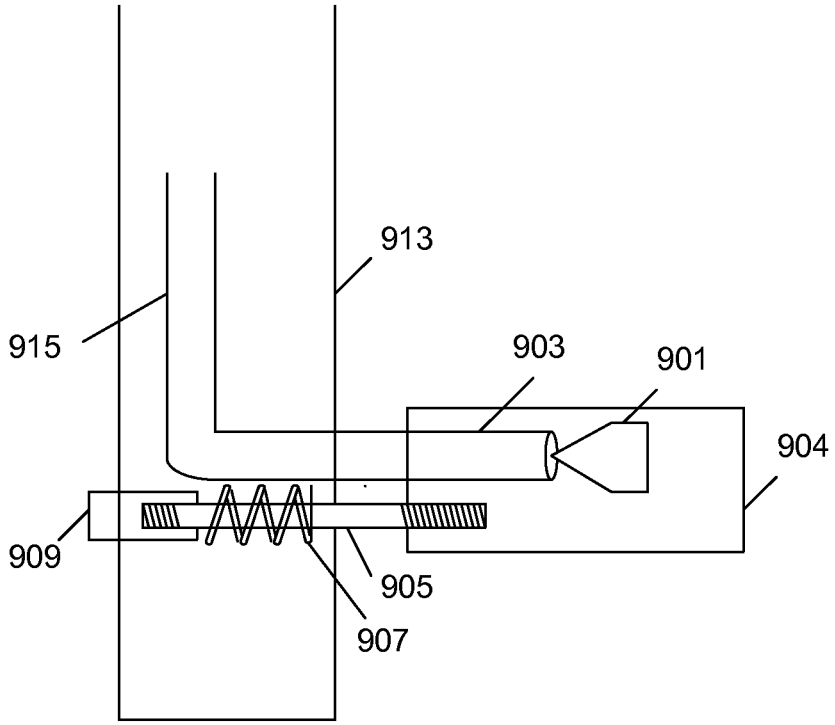
FIG. 9A is a block diagram example of an end-line valve of another example a wine storage and dispensing device with the integrated air removal system.

FIG. 9A is a block diagram example of an end-line valve of another example a wine storage and dispensing device with an integrated air removal system.

A top view of a portion of a wine storage and dispensing device with the integrated air removal system is shown. The conduit 915 may pass through an opening in an inside of a sidewall 913 of the wine storage and dispensing device. The opening may be a tunnel, a recess, or the like, or any combination thereof.

An outside of an end 903 of the conduit 915 may engage an inside of an opening in alignment structure 904 that aligns the stopper 901, e.g. a rubber stopper having a cone-shaped end, with an opening of the end 903 of the conduit 915. The stopper 901 may be inserted into an opening in the alignment structure 904 or integrated with the alignment structure 904. The alignment structure 904 may also be attached to a first threaded end of a threaded rod 905, e.g. the first threaded end of the rod 905 may be screwed into a hole in the alignment structure 904. A second end of the threaded rod may be attached to a back of button 909, e.g. the second threaded end of the rod 905 may be screwed into a hole in the back of the button 909 (in an example the hole lies at the bottom of an opening in the back of the button 909). In an example, a bottom of the alignment structure 904 includes an opening (not shown) so that any wine dripping from the end 903 of the conduit 915 may travel through such opening into an overflow reservoir. To summarize, the alignment structure 904 may have a first opening in a side and a second opening in a bottom (the openings may connect to form a tunnel), and a hole, which may be separate from the openings, to receive the second end of the rod 905.

Button 909, e.g. a cylindrically shaped button, may extend from a surface of sidewall 913 by a first amount when not actuated, e.g. not being pressed, or by a second smaller amount when actuated. The diagram illustrates the button 909 in a position corresponding to actuation, e.g. button 909 is being pressed.

A spring 907 urges the button 909 away from the sidewall 913. A first end of spring 907 may be mounted in a recess of a back of the button 909. A second end of the spring 907 may be in contact with an inside of an opening in the outside of sidewall 913 and/or a spacer, e.g. a plastic or rubber sheath through which the rod 905 passes. In an example, the spacer may be a segment of rubber tubing having an inside diameter that corresponds to a diameter of the rod 905. In an example where the threaded rod 905 has threading from end to end, the spacer may cover a portion of the threading. In an example, the outside of the spacer makes contact with an inside of first diameter hole in an inside of the sidewall 913, and a curved surface of a cylindrically shaped button may contact with an inside of a second greater diameter hole in an outside of the sidewall 913 (the holes may form a tunnel through the sidewall 913). The spring 907 and a portion of the button 909 may be disposed inside the second greater diameter hole in an outside of the sidewall 913.

The threaded rod 905 may set a first distance (the first distance may be zero) between the inside of the sidewall 913 and the alignment structure 904 when the button 909 is not actuated, e.g. may keep the alignment structure 904 in contact and/or adjacent to the inside of the sidewall 913 when the button is not actuated. When the button is actuated (in the illustration the button is in a position corresponding to actuation), the alignment structure 904 is a second greater distance from the inside of the sidewall 903. The second distance is associated with an open valve position, i.e. the tip of the stopper 901 is removed from the opening of the end 903 of the conduit 913. The first distance is associated with a closed valve position. Accordingly, actuating the button 909 provides a similar function as opening the in-line valve in the example wine storage and dispensing device of FIG. 2.

It should be appreciated that, in some examples, the engagement of the outside of the end 903 of the conduit 915 with the inside of the opening of the alignment structure 904 may partially support a position of the alignment structure 904. For example, this engagement may prevent a pivoting of the alignment structure 904 and/or the combination of the alignment structure 904, the rod 905, and/or the button 909.

Figure 9B:
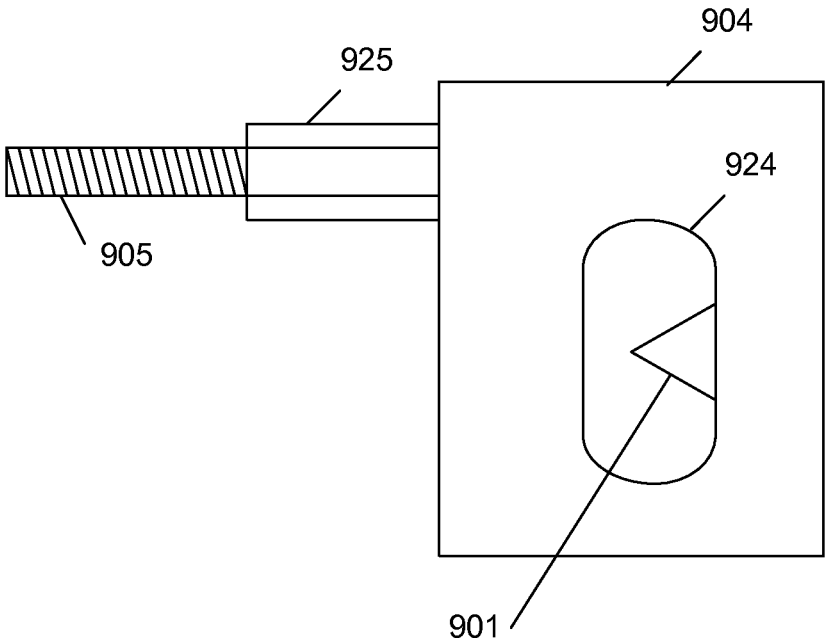
FIG. 9B is a bottom view of the alignment structure of FIG. 9A.

FIG. 9B is a bottom view of the alignment structure of FIG. 9A.

The alignment structure 904 includes an opening 924 in the bottom of the alignment structure 904. In the illustrated example, the opening 924 forms a tunnel with the opening in a side of the alignment structure 904 (side not shown), and as such, the stopper 901 in the opening of the side may be viewed through the opening 924. The rod 905 installed into the alignment structure 904 is shown. A spacer 925 is shown around the rod 905.

Having described and illustrated the principles of the invention in a preferred embodiment thereof, it should be apparent that the invention may be modified in arrangement and detail without departing from such principles. We claim all modifications and variations coming within the spirit and scope of the following claims.

The invention claimed is:

1. A wine storage and dispensing device, comprising:

a wine storage reservoir having a first opening and a second opening that is different than the first opening, the second opening located above the first opening on the wine storage reservoir;

a dispensing device coupled to the first opening of the wine storage reservoir; and an air removal system coupled to the second opening of the wine storage reservoir, the air removal system comprising:

a valve system having an open position to allow a portion of contents of the wine storage reservoir to be forced out of the wine storage reservoir and a close position to lock air out of the wine storage reservoir after forcing the portion of the contents out of the wine storage reservoir; and an overflow reservoir to collect a portion of wine of the evacuated contents;

wherein the air removal system further comprises a mechanical compression system covering a portion of an outside of the wine storage reservoir;

wherein the mechanical compression system further comprises at least one handle, and wherein the mechanical compression system is configured to compress the wine storage reservoir responsive to actuation of the at least one handle; and wherein the mechanical compression system further comprises a plurality of paddles, wherein each paddle of the plurality is configured to press on a corresponding portion of the outside of the wine storage reservoir responsive to actuation of the at least one handle; and a housing for the wine storage reservoir and the air removal system; and an opening in a sidewall of the housing;

wherein the air removal system includes a conduit coupled to the second opening, wherein at least a portion of the conduit is non-opaque, and wherein the opening in the sidewall of the housing is proximate to the non-opaque portion of the conduit.

2. A wine storage and dispensing device, comprising:

a wine storage reservoir having a first opening and a second opening that is different than the first opening, the second opening located above the first opening on the wine storage reservoir;

a dispensing device coupled to the first opening of the wine storage reservoir; and an air removal system coupled to the second opening of the wine storage reservoir, the air removal system comprising:

a valve system having an open position to allow a portion of contents of the wine storage reservoir to be forced out of the wine storage reservoir and a close position to lock air out of the wine storage reservoir after forcing the portion of the contents out of the wine storage reservoir; and an overflow reservoir to collect a portion of wine of the evacuated contents;

wherein the air removal system further comprises a vacuum system coupled to a conduit of the second opening.

* * * * *